United States Patent [19]

Mulliner

[11] Patent Number: 5,035,409

[45] Date of Patent: Jul. 30, 1991

[54] VACUUM CHUCK

[75] Inventor: Leslie E. Mulliner, Reading, England

[73] Assignee: MPL Precision Limited, Reading, England

[21] Appl. No.: 458,513

[22] Filed: Dec. 28, 1989

[51] Int. Cl.[5] ..... B25B 11/00

[52] U.S. Cl. ..... 269/21

[58] Field of Search ..... 269/21; 51/235; 298/362, 363; 279/3; 294/64 A, 65 B; 83/925 CC; 137/855

[56] References Cited

U.S. PATENT DOCUMENTS

| | | | |
|---|---|---|---|
| 3,907,268 | 9/1975 | Hale | 269/21 |
| 4,095,750 | 6/1978 | Gilead | 137/855 |
| 4,487,662 | 12/1984 | Fischbeck | 137/855 |
| 4,642,037 | 2/1987 | Fritchman | 137/855 |
| 4,646,945 | 3/1987 | Steiner et al. | 137/855 |

*Primary Examiner*—Robert C. Watson

*Attorney, Agent, or Firm*—Finnegan, Henderson, Farabow, Garrett & Dunner

[57] ABSTRACT

The invention provides a vacuum chuck for retaining a planar workpiece. The chuck comprises a support member (1) providing a planar surface (2) for supporting a workpiece (3). Passages (4*a*, 4*b*), extend through the support member (1) from said planar surface (2) thereof, said passages each being connected to a source of vacuum at a particular pressure. Valves (5, 5*a*), are provided for closing each said passage (4*a*, 4*b*), when the passage is subjected to both atomspheric pressure and said vacuum pressure simultaneously, said valves (5, 5*a*) remaining open when subjected to either atmospheric pressure or said vacuum pressure alone. By this arrangement the workpiece (3) can be cut or apertured without interfering with the vacuum pressure acting on the workpiece (3).

21 Claims, 2 Drawing Sheets

Figure 1:
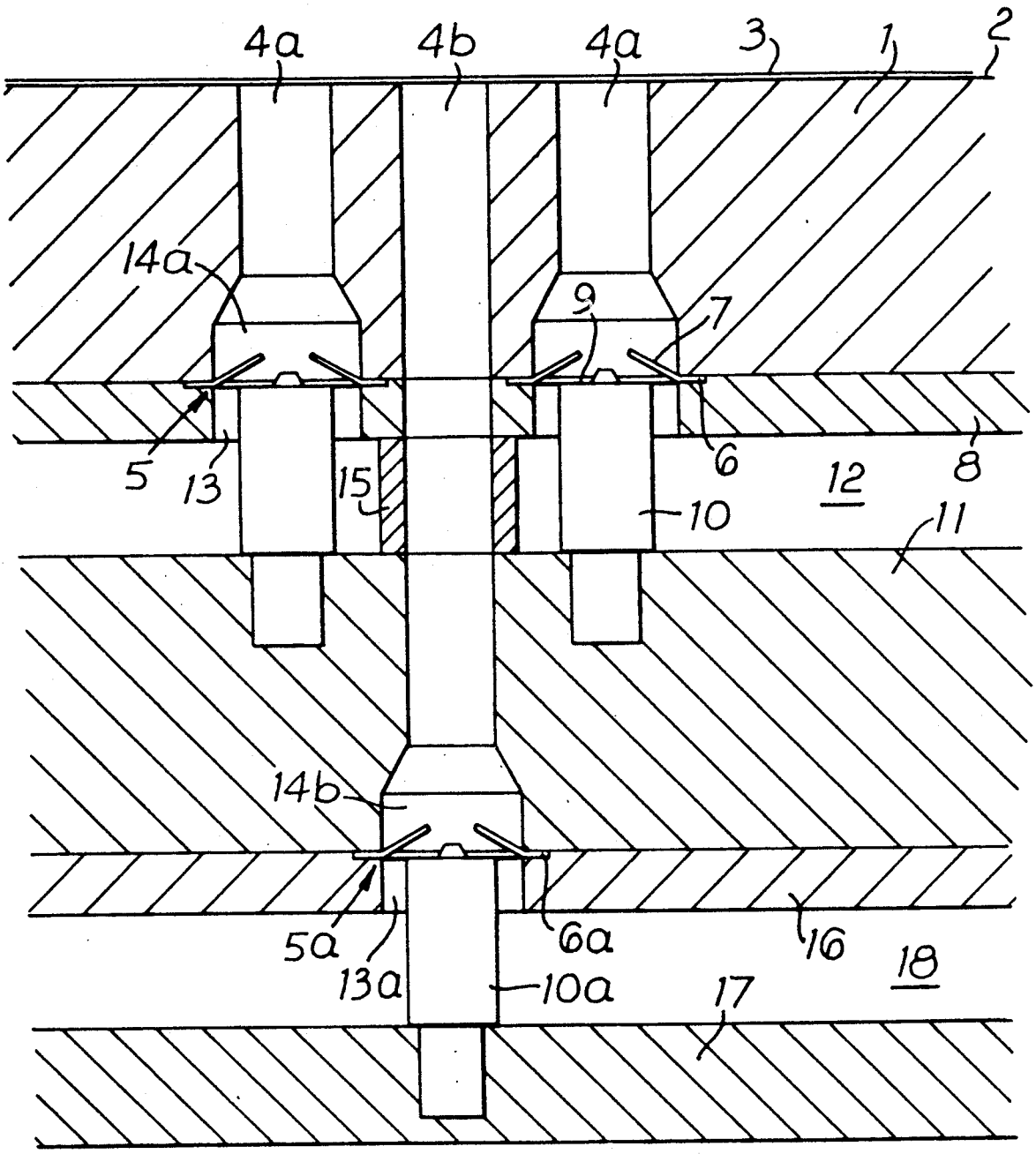

Fig. 3
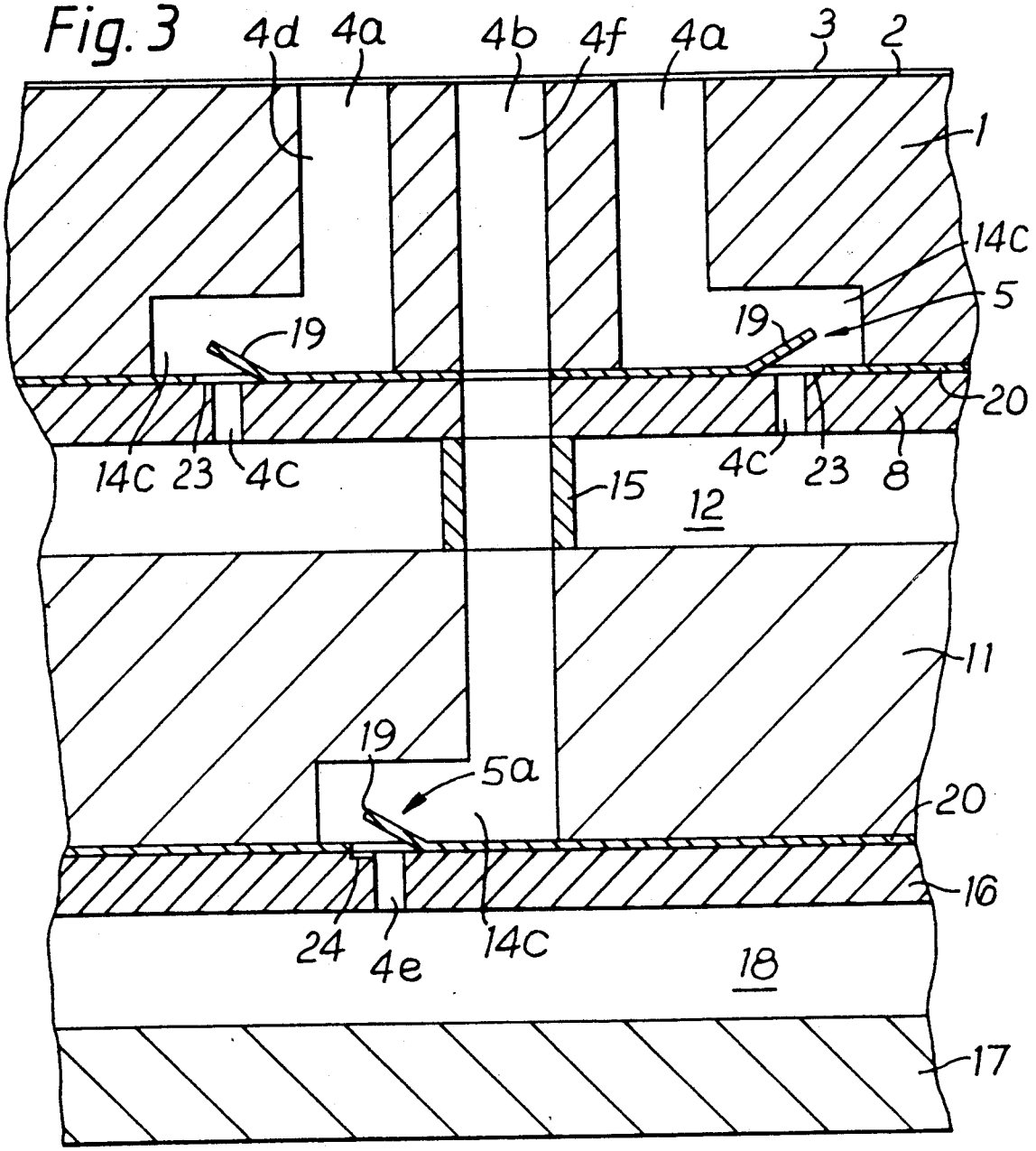
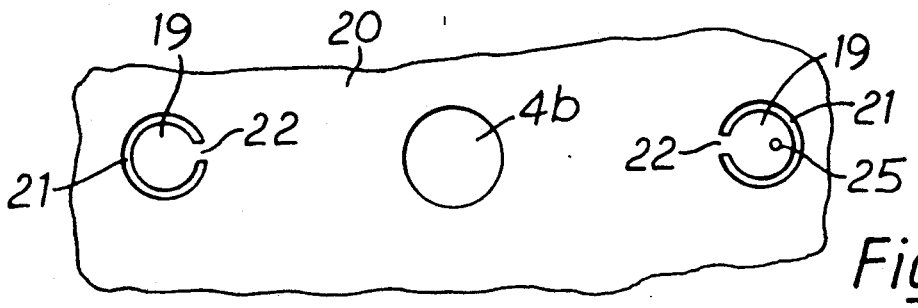
Fig. 4

VACUUM CHUCK

This invention relates to vacuum chucks.

Vacuum chucks are used for retaining planar workpieces, such as printed or other electrical circuits, in a fixed position during manufacturing operations or testing. Vacuum chucks have not hitherto been suitable for use where the workpiece is to be cut or apertured, e.g., drilled, because cutting or aperturing of the workpiece immediately releases the vacuum pressure so that the workpiece is no longer firmly held by the vacuum chuck. This problem can be overcome when the workpiece is rigid by simply applying mechanical clamping pressure to the edges of the workpiece. However, where the workpiece is flexible e.g., is a flexible printed or other electrical circuit, clamping of the workpiece by its edges is not possible. There is accordingly a need for some form of means for securely holding planar flexible workpieces, such as flexible printed circuits, while cutting and/or aperturing operations are carried out thereon and the present invention has as its object to provide a vacuum chuck which will meet this requirement.

The present invention provides a vacuum chuck for retaining a planar workpiece, the chuck comprising a support member providing a planar surface for supporting a said workpiece, passages extending through said support member from said planar surface thereof, said passages each being connected to a source of vacuum at a particular pressure, and valve means for closing each said passage when the passage is subjected to both atmospheric pressure and said vacuum pressure simultaneously.

Said valve means may comprise a normally open valve associated with each said passage, each said valve being adapted to open or remain open when subjected to either atmospheric pressure or said vacuum pressure alone and to close when subjected to both atmospheric pressure and said vacuum pressure simultaneously. Each said valve may comprise a flap valve, e.g., in the form of a slit silicone disc.

Each of said passage may be of larger cross-sectional dimensions e.g., larger diameter, at that end thereof remote from said planar surface and said valve may be provided in the larger dimension portion of each passage. To this end at least some of said valves may be mounted between said support member and a clamping plate secured to the support member and said passages may extend through the clamping plate.

Each said valve may cooperate with a valve seat and such valve seat may be provided by the surfaces of said clamping plate around each of said passages entering therethrough e.g., and end surface of a peg or pin which projects into a said passage. Such pegs or pins may be mounted on a planar member spaced from said clamping plate and the space between the planar member and the clamping plate may be connected to said vacuum source and at least some of said passages may communicate with said space.

At least one of said passages may extend through said planar member and through a spacer member provided between the planar member and said clamping plate and the valve associated with the or each said at least one passage may be mounted between said planar member and a planar clamping member secured thereto with said at least one passage extending through said planar clamping member. The peg or pin providing said valve seat and extending into said at least one passage may be mounted on a base planar member spaced from said planar clamping member. Alternatively the valve vent may be provided by the surface of the planar clamping member around said at least one passage extending therethrough. The space between said base planar member and said planar clamping member may be connected to said vacuum source and said at least one passage may open into said space. With this arrangement the larger dimension portion of the at least one pasage and the valve provided therein is provided in said planar member to enable a closer spacing of the passages in said support member.

Each said mode means may comprise bleed means, and as a bleed channel or passage in the valve seat or a bleed part in the valve flap where the valve means comprises a flap valve. The bleed means serves to ensure that the valve means will be open if subjected to either atmospheric pressure or said vacuum pressure alone.

That part of each said passage extending through said clamping plate or said planar clamping member may be offset from that part of the passage adjacent the planar surface to ensure that the valve means is not damaged by, e.g., laser cutting means used to cut a workpiece supported on the planar surface.

Figure 2:
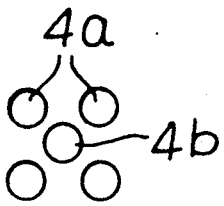

The invention will be more particularly described with reference to the accompanying drawings, in which:

FIG. 1 is a fragmentary sectional elevation on an enlarged scale of one embodiment of a vacuum chuck according to the present invention, FIG. 2 is a diagrammatic illustration on a smaller scale of a preferred arrangement of a group of passages extending through the support member, FIG. 3 is a fragmentary sectional elevation on an enlarged seals of another embodiment of a vacuum chuck according to the invention and, FIG. 4 is an enlarged fragmentary plan view of valve means used in the embodiment of FIG. 3.

Referring to FIG. 1 it will be seen that the vacuum chuck illustrated therein comprises a support member 1 providing a planar surface 2 for supporting a planar workpiece 3 and having a series of passages 4 extending therethrough from said planar surface 2 thereof. A valve shown generally at 5 or 5*a* is associated with each of the passages 4. Each of the valves 5 comprises a silicone disc 6 which is clamped between the lower surface of the support member 1 and a clamping plate 8 secured to the underside of the support member 1 and which has been slit to provide resilient flaps 7 having sufficient shape memory to normally remain open as shown. The flaps 7 of each valve 5 cooperate with a valve seat 9 provided by an end surface of a peg or pin 10 which extends into its associated passage 4*a* and which is mounted on and extends upwardly from a planar member 11 spaced from the clamping plate 8. The space 12 between the clamping plate 8 and the planar member 11 is connected to a source of vacuum (not shown) and each of the passages 4*a* opens into the space 12 as shown at 13. Each of the valves 5 is accommodated in an enlarged diameter portion 14*a* of each of the passages 4*a*.

The passage 4*b* extends through a spacer 15 between the clamping plate 8 and the planar member 11, through the planar member 11 and through a planar clamping member 16 secured to the underside of the planar member 11. As with the passages 4*a*, the passage 4*b* has a lower portion 14*b* of enlarged diameter which accommodates the valve 5*a*. The valve 5*a* is exactly the same as the valves 5 except that the silicone disc 6*a* thereof is mounted between the planar member 11 and the planar clamping member 16 and the peg or pin 10*a* thereof is mounted on a base planar member 17 spaced from the planar clamping member 16. The space 18 between the planar clamping member 16 and the base planar member 17 is connected to the source of vacuum (not shown) and the lower end of the passage 4*b* opens into the space 18 as shown at 13*a*. By arranging the passage 4*b* and valve 5*a* as shown a closer spacing of the passages 4*a*, 4*b*, is enabled.

As shown in FIG. 2, the passages 4 are preferably arranged in groups of five with each passage 4*b* surrounded by four equally spaced passages 4*a*. Although only one group of passages 4 is shown in the drawings it will be understood that similar groups will be provided over the whole of the surface 2 of the support member 1.

The resiliency of the flaps 7 of the valves 5, 5*a* is so chosen that each valve will remain open when subjected to atmospheric pressure or a particular vacuum pressure alone and will close to close its associated passage when subjected to both atmospheric pressure and the particular vacuum pressure simultaneously.

The vacuum chuck illustrated in FIGS. 3 and 4 is similar to that shown in FIGS. 1 and 2 and like parts have been given like reference numerals.

Referring now to FIGS. 3 and 4 it will be seen that the passages 4*a*, 4*b* each have a portion of enlarged cross-section 14*c* in each of which a valve 5 or 5*a* is accommodated. The portion 4*c* of each passage 4*a* which extends through the clamping plate 8 is offset from that part 4*d* of the passage 4*a* adjacent the planar surface 2. Likewise the portion 4*e* of the passage 4*b* which extends through the planar clamping member 16 is offset from that part 4*f* of the passage 4*b* adjacent the planar surface 2. In this way a laser beam used to cut or aperture the workpiece 3 and travelling down a passage 4*a* or 4*b* will not cause damage to the valve 5 or 5*a* in that passage.

The valves 5, 5*a*, of this embodiment each comprise a flap 19 formed in a silicone sheet 20 by cutting arcuate slots 21 therein as shown in FIG. 4 so as to leave the flap 19 connected to the sheet 20 by an integral hinge 22. Each valve 5, 5*a* is formed so that the flap 19 thereof is normally open as shown in FIG. 3. The silicone sheets 20 having the valves 5, 5*a* therein are clamped one between the support member 1 and the clamping plate 8 and the other between the planar member 11 and the planar clamping member 16. The passage 4*b* passes through the silicone sheet 20 which is clamped between the support member 1 and the clamping plate 8. The flaps 19 seat on the upper surfaces of the clamping plate 8 and the planar clamping member 16 around the apertures 4*c* and 4*e* as indicated at 23 in FIG. 3.

The flaps 19 are adapted to close when subjected to both atmospheric pressure and a predetermined vacuum pressure simultaneously and to open when subjected to either atmospheric pressure or said predetermined vacuum pressure alone. To ensure that the flaps 19 will open when subjected to either atmospheric pressure or said predetermined vacuum pressure above suitable bleed means may be provided. Each bleed means may comprise, for example, a bleed passage 24 in each of the valve seats 23 as shown in FIG. 3 or a bleed part 25 in each of the flaps 19 as shown in FIG. 4.

In the use of the vacuum chuck, a workpiece 3 is located in a required position on the surface 2 of the support member 1 as by means of suitable stops (not shown) and vacuum pressure is applied to the spaces 12 and 18 and hence to the passages 4*a*, 4*b*. Any passages 4*a*, 4*b*, not covered by the workpiece 3 will be subjected to both atmospheric pressure and to vacuum pressure and accordingly the valves 5, 5*a* therein will close to close those passages and thus ensure that the vacuum pressure acts on the workpiece 3 to draw the workpiece 3 into tight contact with the surface 2 of the support member 1. Where the passages 4*a*, 4*b* are covered by the workpiece 3, sufficient air will be exhausted from the passages 4*a*, 4*b* either before the valves 5, 5*a* therein close fully or through the bleed means 24 or 25 to ensure that the pressure acting on those valves is less than the sum of the vacuum pressure and atmospheric pressure and accordingly these valves will open or remain open so that the vacuum pressure can act on the workpiece 3. If the workpiece 3 is subsequently cut or apertured in the region of a passage 4*a*, 4*b*, that passage will immediately be subjected to both atmospheric pressure and vacuum pressure simultaneously and accordingly the valve 5, 5*a* associated therewith will close to close that passage and so maintain the vacuum pressure acting on the workpiece 3.

It will be understood that the embodiments shown in the drawings are for illustration only and that modifications may be made thereto. For example, if it is found that the passages 4*b* are not required then the planar member 11, planar clamping member 16, valves 5*a* and space 18 may be omitted and the planar member 11 replaced by the base planar member 17 so that the space 12 is defined between the clamping plate 8 and the base planar member 17.

I claim:

1. A vacuum chuck for retaining a planar workpiece, the chuck comprising a support member providing a planar surface for supporting a said workpiece, passages extending through said support member from said planar surface thereof, said passages each being connected to a source of vacuum at a particular pressure and being open to atmospheric pressure unless completely closed by a said workpiece, and normally open valve means associated with each said passage, each said valve means being adapted to open or remain open when subjected to either atmospheric pressure or said vacuum pressure alone and to close when subjected to both atmospheric pressure and said vacuum pressure simultaneously.

2. A vacuum chuck according to claim 1, wherein each said valve means comprises a flap valve.

3. A vacuum chuck according to claim 2, wherein each said valve comprises a slit silicone disc.

4. A vacuum chuck according to claim 2, wherein said valves are all formed in a sheet of silicone.

5. A vacuum chuck according to claim 4, wherein each said valve is formed in said sheet by forming an arcuate slot in said sheet to define a flap connected to the sheet by an integral hinge.

6. A vacuum chuck according to claim 1, wherein each said passage is of larger diameter at an end thereof remote from said planar surface and wherein said valve means is provided in a larger diameter portion of each said passage.

7. A vacuum chuck according to claim 1, wherein at least some of said valve means are mounted between said support member and a clamping plate secured to the support member and wherein said passages extend through the clamping plate.

8. A vacuum chuck according to claim 7, wherein that portion of each passage extending through said clamping plate is offset from the portion of the passage adjacent said planar surface.

9. A vacuum chuck according to claim 7, wherein each said valve means cooperates with a valve seat.

10. A vacuum chuck according to claim 7, wherein a surface of said clamping plate around each said passage extending therethrough provides a valve seat for a said valve means.

11. A vacuum chuck according to claim 9, wherein each said valve seat is provided by an end surface of a peg or pin which extends into said passage.

12. A vacuum chuck according to claim 7, wherein a space is provided between a planar member and said clamping plate, the space being connected to said vacuum source and at least some of said passages communicate with said space.

13. A vacuum chuck according to claim 12, wherein pegs or pins are mounted on said planar member and extend into the passages in the clamping plate to provide valve seats for said valve means.

14. A vacuum chuck according to claim 12, wherein at least one of said passages extends through said planar member and through a spacer member provided between the planar member and said clamping plate.

15. A vacuum chuck according to claim 14, wherein the valve means associated with said at least one passage is mounted between said planar member and a planar clamping member secured thereto and wherein portion said at least one passage extends through said planar clamping member.

16. A vacuum chuck according to claim 15, wherein that portion of said at least one passage extending through said planar clamping member is offset from that part of the passage adjacent said planar surface.

17. A vacuum chuck according to claim 15, wherein a space is provided between a base planar member and said planar clamping member, said space between said base planar member and said planar clamping member is connected to said vacuum source and said at least one passage opens into said space.

18. A vacuum chuck according to claim 17 wherein a surface of said planar clamping member around that portion of said at least one passage extending therethrough provides a valve seat for a said valve means.

19. A vacuum chuck according to claim 17 wherein a peg or pin is mounted on said base planar member and extends into said at least one passage to provide a valve seat for a said valve means.

20. A vacuum chuck according to claim 1, wherein said valve means comprises bleed means.

21. A vacuum chuck according to claim 20, wherein the valve means comprises a flap valve and valve seat associated with each said passage and said bleed means comprises a bleed port in the flap of the valve or a bleed passage in the valve seat.

* * * * *

UNITED STATES PATENT AND TRADEMARK OFFICE

CERTIFICATE OF CORRECTION

PATENT NO. : 5,035,409

DATED : July 30, 1991

INVENTOR(S) : Leslie E. MILLINER

It is certified that error appears in the above-identified patent and that said Letters Patent is hereby corrected as shown below:

Claim 15, column 6, line 2, change "portion" to --a portion of--.

Signed and Sealed this

Tenth Day of November, 1992

*Attest:*

DOUGLAS B. COMER

*Attesting Officer*

*Acting Commissioner of Patents and Trademarks*